United States Patent [19]

Sims

[11] 4,253,605

[45] Mar. 3, 1981

[54] RAILWAY CROSSING STRUCTURE

[76] Inventor: Robert L. Sims, 5145 Bald Eagle Ave., White Bear Lake, Minn. 55110

[21] Appl. No.: 42,101

[22] Filed: May 23, 1979

[51] Int. Cl.[3] ..... E01B 2/00

[52] U.S. Cl. ..... 238/8

[58] Field of Search ..... 238/8, 3, 4, 9

[56] References Cited

U.S. PATENT DOCUMENTS

| | | | |
|---|---|---|---|
| 1,354,935 | 10/1920 | Wooldridge | 238/8 |
| 1,550,519 | 8/1925 | Drennon | 238/8 |
| 1,844,912 | 2/1932 | Eckhart | 238/8 |
| 2,984,417 | 5/1961 | Voorhees | 238/8 |
| 3,469,783 | 9/1969 | Vralli et al. | 238/8 |
| 3,517,882 | 6/1970 | Hooper | 238/8 |
| 3,894,686 | 7/1975 | Weinberg et al. | 238/8 |

*Primary Examiner*—Richard A. Bertsch

[57] ABSTRACT

A pair of channel members are fastened by lag bolts between the rails, and a single channel member is fastened on each outer side thereof, each channel member being formed of a pair of U-shaped steel channels welded together in side by side relationship. A metal plate is welded across the upper, open portions of each channel member, the upper surface of the metal plates being coated with epoxy and a non-skid aggregate.

3 Claims, 6 Drawing Figures

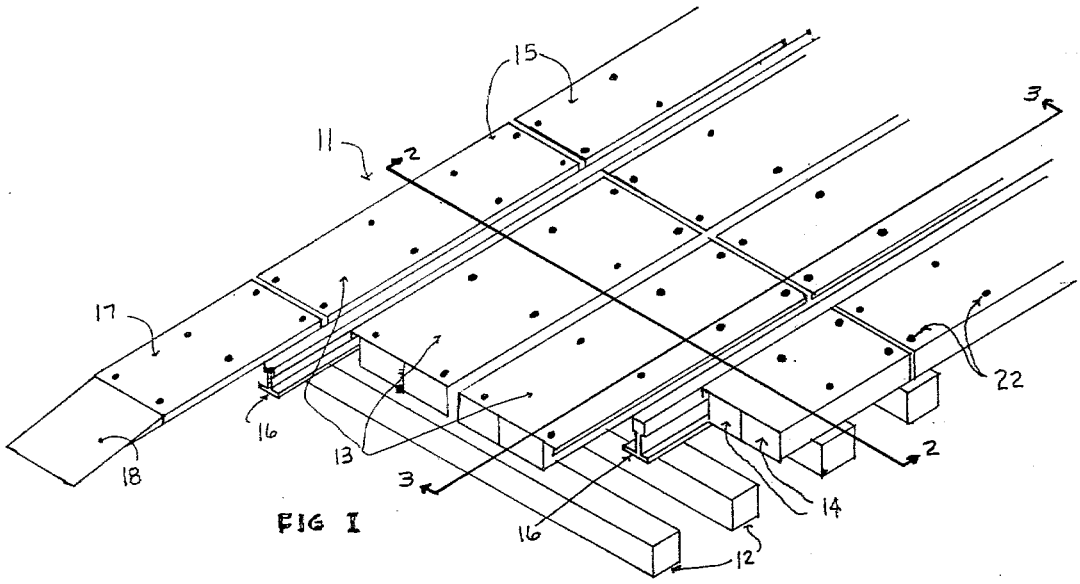
FIG I
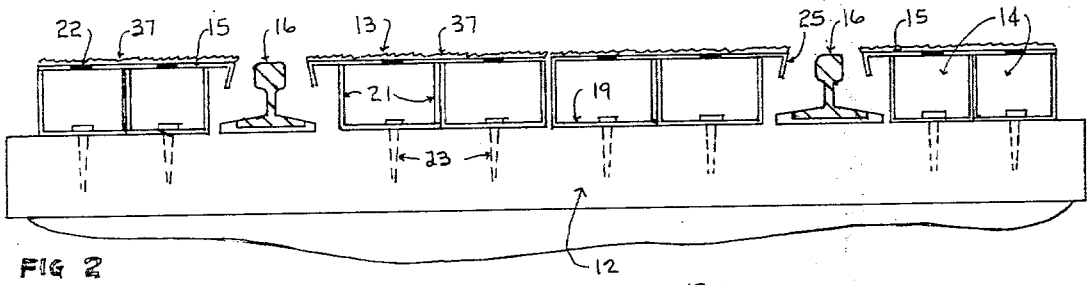
FIG 2
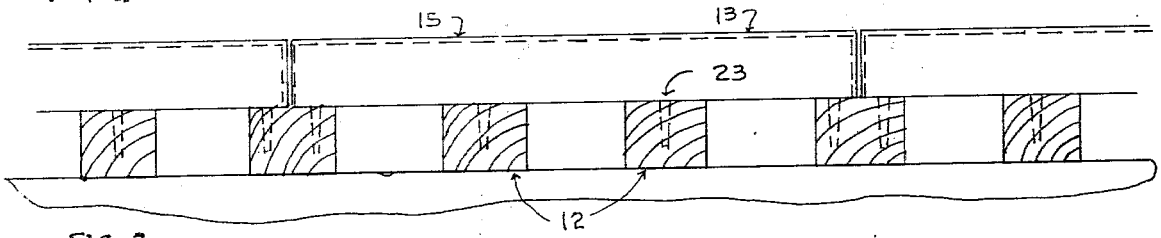
FIG 3
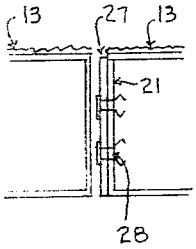
FIG 4
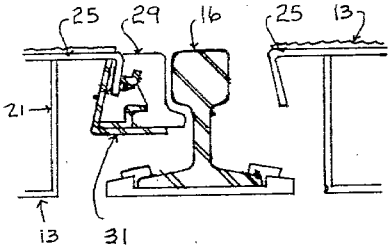
FIG 5
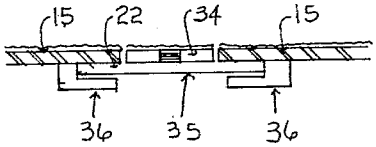
FIG 6

RAILWAY CROSSING STRUCTURE

BACKGROUND OF THE INVENTION

This invention relates to railway crossing structures and more particularly to an improved all metal crossing structure.

The most commonly used railway crossing structures have been formed of a plurality of wooden planks secured between the rails and on either side thereof. Heavy traffic and bad weather can result in rapid deterioration of wood crossing structures, and they are usually in need of frequent inspection to assure that they are in operable condition.

More recently, steel crossing structures have been developed, and such structures have substantially reduced problems of wear. Yet steel structures have exhibited other problems, such as difficulty of installation, higher skidding characteristics, high cost, etc. Presently available steel crossing structures (such as those disclosed in U.S. Pat. Nos. 2,854,194; 2,960,918; and 3,517,882) have failed to provide low-cost, easily installable and low-skid crossings required to replace existing wooden structures.

SUMMARY OF THE INVENTION

In accordance with this invention there is provided an improved metal crossing structure comprising four channel members, two of which are fastened between the rails, with each of the other two fastened on the outer sides of the rails. The channel members are formed of U-shaped steel channels welded or otherwise secured together in side-by-side relationship, with their open sides facing upward. Metal plates are secured across the open upper sides of each channel member, the plates and channels having apertures such that each channel member can be secured by lag bolts or other fasteners directly to the railroad ties. An epoxy coating containing aggregate is applied to the outer surface of the metal plates.

It is a primary object of this invention to provide a prefabricated metal railway crossing structure that can be installed by a minimum of unskilled workers, and without the need for special or heavy equipment.

It is another object of this invention to provide a metal railway crossing structure that can be manufactured at low cost using the fewest number of component parts.

It is further object of this invention to provide a low skid railway crossing structure capable of replacing wood crossing structures.

BRIEF DESCRIPTION OF DRAWINGS

FIG. 1 is a perspective view of the railway crossing structure of this invention;

FIG. 2 is an elevational view, in cross section, of the structure shown in FIG. 1, taken along line 2—2;

FIG. 3 is an elevational view, in cross section, of the structure shown in FIG. 1, taken along line 3—3;

FIG. 4 is elevational view of a portion of a channel member;

FIG. 5 shows a modified end portion of a channel member; and

FIG. 6 shows a cover for the access aperture in the metal plates.

DESCRIPTION OF THE PREFERRED EMBODIMENT

In FIG. 1, the crossing structure designated generally by 11 is secured to railroad ties 12, as will be shown in FIGS. 2, 3, the crossing structure 11 being formed of four separate channel members 13. Each channel member 13 is in turn formed of a pair of U-shaped steel channels 14 welded together in side-by-side relationship. A metal plate 15 is welded across the upper portions of each channel member 13. A pair of channel members 13 are secured to the ties 12 between the rails 16, and in parallel relation thereto. Each of the remaining channel members 13 is fastened to ties 12 on the outer sides of rails 16, with the outer sides of such channel members abutting the roadway (not shown) with their upper surfaces flush with the road surface. The outer channel members 13, such as that designated 17, can be provided with tapered ends 18, which are continuations of the metal plates 15 after scoring and bending, as shown.

As shown in FIG. 2, each U-shaped channel 14 has bottom panel 19 and side walls 21. The channels 14 are welded together in side-by-side relationship, and metal plate 15 is welded to the upper edges of side walls 21 to provide a completed channel member 13. Access apertures 22 are formed in the metal plates 15, the apertures being aligned with apertures (not shown) in the bottom panels 19 of channels 14, so that lag bolts and tools can be inserted through apertures 22 and the lag bolts 23 can be attached to the ties 12. Flanges 25 can be formed in the rail sides of the channel members 13, to prevent materials from falling between the rails. The center channel members, disposed between rails 16, are spaced slightly apart from each other, to allow drainage of water.

The apertures 22 are positioned such that the channel members 13 can be fastened to ties 12 along each successive tie. In all, from eight to ten fasteners can be used for each channel member, two for each tie. The use of channel members as thus disclosed results in a completely firm attachment of the crossing structure to the ties.

FIG. 4 shows a portion of the center channel members 13, and an additional insulating strip 27 secured by rivets 28 or similar fasteners to side walls 21. The insulating strips can be formed of rubber or a similar non-conducting material. The strips will prevent signal systems from shorting out from one channel member to another.

FIG. 5 shows a filler strip 29 secured by bracket 31 to the flange 25 of a channel member 13 disposed between the rails. Filler strip 29 can be formed of metal or hard rubber, and will prevent objects from falling between the rail and the center channel member.

FIG. 6 shows cover 32 for aperture 22 located on metal plate 15 of each channel member 13. The cover 32 has a knob portion 34 and a deformable sealing portion 35, the latter being firmly held in position by brackets 36 attached to the underportion of plate 15. The covers 32 prevent water or objects from falling into the channel members, and are removable to allow access to the fasteners holding the channel members to the ties.

The entire upper surface of metal plates 15 is covered with an epoxy coating 37, as shown in FIG. 2, containing aggregate to provide a durable, non-skid surface for the crossing structure. Conventional epoxies and aggregates can be used.

A primary advantage of the crossing structure of this invention is the ease with which it can be installed. Prior metal crossing structures, such as that disclosed in U.S. Pat. No. 3,517,882, have been formed of large structural elements, thus requiring a number of workers and considerable time and equipment for installation. Crossing structure 11, prefabricated in separate channel members 13, avoids such installation problems. Each channel member is completely separate, and can be positioned and fastened to the ties using only a single worker.

I claim:

1. A prefabricated railway crossing structure comprising: four channel members, each channel member formed of two U-shaped metal channels with each channel having a rectangular cross section and being welded to an adjacent channel in side-by-side relationship, with a metal plate welded across the upper, open portions of each pair of channels, the metal plate and the bottom portion of each channel member having aligned apertures such that fasteners can be inserted through the plate for fastening one pair of channel members to successive railroad ties between the rails in parallel relationship thereto and in slightly spaced apart relationship, and for fastening each of the other two channel members to successive railroad ties on the outside area of the rails.

2. The railway crossing structure of claim 1 wherein each channel member has apertures to accommodate thirty two fasteners.

3. The railway crossing structure of claim 1 wherein each channel member is about 60 inches in length and weighs about 300 pounds.

* * * * *